US008778580B2

(12) United States Patent
Tsuji et al.

(10) Patent No.: US 8,778,580 B2
(45) Date of Patent: Jul. 15, 2014

(54) ELECTROPHOTOGRAPHIC PHOTOSENSITIVE MEMBER, PROCESS CARTRIDGE, AND ELECTROPHOTOGRAPHIC APPARATUS

(75) Inventors: Haruyuki Tsuji, Yokohama (JP); Atsushi Fujii, Yokohama (JP); Hideaki Matsuoka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 13/384,149

(22) PCT Filed: Sep. 3, 2010

(86) PCT No.: PCT/JP2010/065572

§ 371 (c)(1),
(2), (4) Date: Jan. 13, 2012

(87) PCT Pub. No.: WO2011/027912

PCT Pub. Date: Mar. 10, 2011

(65) Prior Publication Data

US 2012/0121291 A1 May 17, 2012

(30) Foreign Application Priority Data

Sep. 4, 2009 (JP) ..... 2009-204523
Jun. 11, 2010 (JP) ..... 2010-134305
Sep. 2, 2010 (JP) ..... 2010-196406

(51) Int. Cl.
*G03G 5/04* (2006.01)

(52) U.S. Cl.
USPC ..... 430/63; 430/62; 399/159

(58) Field of Classification Search
USPC ..... 430/62, 63; 399/159
See application file for complete search history.

(56) References Cited

U.S. PATENT DOCUMENTS 5,171,480 A * 12/1992 Yoshinaka et al. ..... 252/519.32
5,357,320 A 10/1994 Kashimura et al.
(Continued)

FOREIGN PATENT DOCUMENTS

CN 1826665 A 8/2006
JP 58-161923 A 9/1983
(Continued)

OTHER PUBLICATIONS

PCT International Search Report and Written Opinion of the International Searching Authority, International Application No. PCT/JP2010/065572, Mailing Date Dec. 14, 2010.
(Continued)

*Primary Examiner* — Peter Vajda
*Assistant Examiner* — Olatunji Godo
(74) *Attorney, Agent, or Firm* — Fitzpatrick, Cella, Harper and Scinto

(57) ABSTRACT

An electrophotographic photosensitive member having a specific conductive layer and promising less variation in light-area potential and residual potential in reproducing images repeatedly, and a process cartridge and an electrophotographic apparatus which have such an electrophotographic photosensitive member are provided. Where a test in which a voltage of −1.0 kV having only a DC voltage component is continuously applied to the conductive layer for 1 hour is conducted, the conductive layer has volume resistivity satisfying the following mathematical expressions (1) and (2), as values before and after the test:

$$-2.00 \leq (\log|\rho_2| - \log|\rho_1|) \leq 2.00 \quad (1), \text{ and}$$

$$1.0\times10^{8} \leq \rho_1 \leq 2.0\times10^{13} \quad (2),$$

where, in the expressions (1) and (2), $\rho_1$ is volume resistivity (Ω·cm) of the conductive layer as measured before the test and $\rho_2$ is volume resistivity (Ω·cm) of the conductive layer as measured after the test.

8 Claims, 2 Drawing Sheets

(56) References Cited

U.S. PATENT DOCUMENTS

| | | | | |
|---|---|---|---|---|
| 5,385,797 | A | 1/1995 | Nagahara et al. | |
| 5,422,210 | A | 6/1995 | Maruyama et al. | |
| 5,455,135 | A | 10/1995 | Maruyama et al. | |
| 5,485,250 | A | 1/1996 | Kashimura et al. | |
| 5,488,461 | A | 1/1996 | Go et al. | |
| 5,853,936 | A | 12/1998 | Segi et al. | |
| 6,156,472 | A | 12/2000 | Segi et al. | |
| 6,773,856 | B2 | 8/2004 | Tanaka et al. | |
| 6,773,857 | B2 | 8/2004 | Nakamura et al. | |
| 7,211,357 | B2 | 5/2007 | Hosoi et a | |
| 7,245,851 | B2 | 7/2007 | Fujii et al. | |
| 7,276,318 | B2 | 10/2007 | Fujii et al. | |
| 7,333,752 | B2 | 2/2008 | Kawahara et al. | |
| 7,407,606 | B2 | 8/2008 | Chiba et al. | |
| 7,517,626 | B2 | 4/2009 | Fujii et al. | |
| 7,629,102 | B2 | 12/2009 | Ochi et al. | |
| 7,732,113 | B2 | 6/2010 | Nakamura et al. | |
| 7,910,274 | B2 | 3/2011 | Tanaka et al. | |
| 8,088,541 | B2 | 1/2012 | Tanaka et al. | |
| 2004/0265715 | A1 | 12/2004 | Itami et al. | |
| 2006/0208228 | A1* | 9/2006 | Chiba et al. | 252/500 |
| 2009/0136256 | A1* | 5/2009 | Nakamura et al. | 399/111 |

FOREIGN PATENT DOCUMENTS

| | | | |
|---|---|---|---|
| JP | 6-207118 | A | 7/1994 |
| JP | 6-208238 | A | 7/1994 |
| JP | 7-271072 | A | 10/1995 |
| JP | 7-295245 | A | 11/1995 |
| JP | 10-186702 | A | 7/1998 |
| JP | 2003-186219 | A | 7/2003 |
| JP | 2004-349167 | A | 12/2004 |
| JP | 2007-47736 | A | 2/2007 |
| JP | 2007-322996 | A | 12/2007 |
| JP | 2008-96527 | A | 4/2008 |
| JP | 2009-58789 | A | 3/2009 |
| WO | 2005/008685 | A1 | 1/2005 |
| WO | 2009/011072 | A1 | 1/2009 |

OTHER PUBLICATIONS

Fujii, et al., U.S. Appl. No. 13/384,852, 371(c) Date Jan. 19, 2012.
Nakamura, et al., U.S. Appl. No. 13/409,439, filed Mar. 1, 2012.
Chinese Office Action dated Feb. 5, 2013 in Chinese Application No. 201080038710.3.
European Search Report dated Jun. 26, 2013 in European Application No. 10813857.9.
Japanese Office Action dated Nov. 22, 2013 in Japanese Application No. 2011-174926.

* cited by examiner

ELECTROPHOTOGRAPHIC PHOTOSENSITIVE MEMBER, PROCESS CARTRIDGE, AND ELECTROPHOTOGRAPHIC APPARATUS

TECHNICAL FIELD

This invention relates to an electrophotographic photosensitive member, and a process cartridge and an electrophotographic apparatus which have the electrophotographic photosensitive member.

BACKGROUND ART

In recent years, research and development are energetically made on electrophotographic photosensitive members (organic electrophotographic photosensitive members) making use of organic photoconductive materials.

The electrophotographic photosensitive member is basically constituted of a support and a photosensitive layer formed on the support. In the present state of affairs, however, various layers are often formed between the support and the photosensitive layer for the purposes of, e.g., covering any defects of the surface of the support, protecting the photosensitive layer from any electrical breakdown, improving its charging performance, improving the blocking of injection of electric charges from the support into the photosensitive layer, and so forth.

Among such layers formed between the support and the photosensitive layer, a layer containing metal oxide particles is known as the layer formed for the purpose of covering any defects of the surface of the support. The layer containing metal oxide particles commonly has a higher electrical conductivity than a layer not containing any metal oxide particles (e.g., $1.0\times10^{8}$ to $2.0\times10^{13}$ Ω·cm as initial-stage volume resistivity). Thus, even where it is formed in a large layer thickness, any residual potential at the time of image formation can not easily come to increase, and hence any defects of the support surface can be covered with ease. The covering of defects of the support surface by providing between the support and the photosensitive layer such a layer having a higher electrical conductivity (hereinafter "conductive layer) makes the support surface have a great tolerance for its defects. As the results, this makes the support have a vastly great tolerance for its use, and hence brings an advantage that the electrophotographic photosensitive member can be improved in productivity.

Metal oxide particles used in conductive layers of conventional electrophotographic photosensitive members may include, as an example thereof, titanium oxide particles coated with antimony-doped tin oxide (titanium oxide powder the particle surfaces of which have been coated with tin oxide which contains antimony) as disclosed in Patent Literature 1.

However, it is recently studied from the viewpoint of, e.g., easy availability of materials to make up the conductive layer without use of any antimony, and a technique is disclosed in Patent Literature 2, in which titanium oxide particles coated with oxygen deficient tin oxide are used as metal oxide particles for the conductive layer.

As other metal oxide particles, oxygen deficient tin oxide particles are disclosed in Patent Literature 3. Barium sulfate particles coated with oxygen deficient tin oxide are also disclosed in Patent Literature 4. Barium sulfate particles coated with titanium oxide and tin oxide are still also disclosed in Patent Literature 5.

As a technique aiming at metal oxide particles-containing conductive layers of electrophotographic photosensitive members, an electrophotographic photosensitive member is disclosed in Patent Literature 6, in which a conductive layer (intermediate layer) specifies a relationship between its volume resistivity and temperature/humidity (temperature and relative humidity).

CITATION LIST

Patent Literature

PTL 1: Japanese Patent Application Laid-open No. H07-271072

PTL 2: Japanese Patent Application Laid-open No. 2007-047736

PTL 3: Japanese Patent Application Laid-open No. H07-295245

PTL 4: Japanese Patent Application Laid-open No. H06-208238

PTL 5: Japanese Patent Application Laid-open No. H10-186702

PTL 6: Japanese Patent Application Laid-open No. 2003-186219

SUMMARY OF INVENTION

Technical Problem

In recent years, it has become frequent to reproduce halftone images and solid images, and it is highly required to make them have a high image quality. For example, importance is attached to image density and color tone uniformity of images reproduced on one sheet and also to image density and color tone uniformity in reproducing images repeatedly. It has year by year come to be highly required to cope with these.

Especially in recent years, as electrophotographic photosensitive members have been made long-lifetime, it has become longer and more frequent (larger in extents of time and frequency) than ever to reproduce images repeatedly. Hence, it has come about in some cases that even conventional electrophotographic photosensitive members having been sufficiently serviceable can not well meet requirements for the image density and color tone uniformity in reproducing images repeatedly. For example, it has come about in some cases that the electrophotographic photosensitive members disclosed in the above Patent Literatures, having conventional conductive layers, can not well meet requirements for the image density and color tone uniformity.

In regard to the image density and color tone uniformity, these are greatly influenced by the electric potential of an electrophotographic photosensitive member. Hence, in order to lessen any variations in the image density and color tone uniformity in reproducing images repeatedly, it is important to lessen any variations in electric potential, in particular, variations in light-area potential (Vl) and residual potential (Vsl), of the electrophotographic photosensitive member in reproducing images repeatedly.

Accordingly, an object of the present invention is to provide an electrophotographic photosensitive member promising less variation in light-area potential and residual potential in reproducing images repeatedly, and a process cartridge and an electrophotographic apparatus which have such an electrophotographic photosensitive member.

Solution to Problem

The present invention is an electrophotographic photosensitive member which comprises:

a cylindrical support;

a conductive layer formed on the cylindrical support, the conductive layer containing a binder resin and metal oxide particles and not containing any antimony; and a photosensitive layer formed on the conductive layer;

wherein;

where a test in which a voltage of −1.0 kV having only a DC (direct-current) voltage component is continuously applied to the conductive layer for 1 hour is conducted, the conductive layer has volume resistivity satisfying the following mathematical expressions (1) and (2), as values before and after the test:

$$-2.00 \leq (\log|\rho_2| - \log|\rho_1|) \leq 2.00 \quad (1), \text{ and}$$

$$1.0\times10^{8} \leq \rho_1 \leq 2.0\times10^{13} \quad (2),$$

where, in the expressions (1) and (2), $\rho_1$ is volume resistivity (Ω·cm) of the conductive layer as measured before the test and $\rho_2$ is volume resistivity (Ω·cm) of the conductive layer as measured after the test.

Advantageous Effects of Invention

According to the present invention, it can provide an electrophotographic photosensitive member promising less variation in light-area potential and residual potential in reproducing images repeatedly, and a process cartridge and an electrophotographic apparatus which have such an electrophotographic photosensitive member.

Further features of the present invention will become apparent from the following description of exemplary embodiments with reference to the attached drawings.

DESCRIPTION OF EMBODIMENTS

Figure 1:
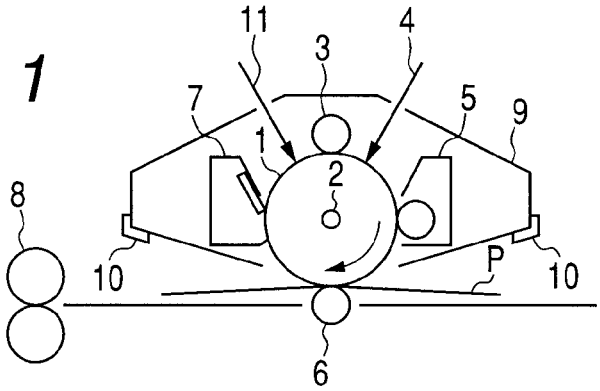
FIG. 1 is a view showing schematically an example of the construction of an electrophotographic apparatus having a process cartridge provided with the electrophotographic photosensitive member of the present invention.

The electrophotographic photosensitive member of the present invention is an electrophotographic photosensitive member having a cylindrical support, a conductive layer formed on the cylindrical support, and a photosensitive layer formed on the conductive layer. The cylindrical support is hereinafter simply termed also as "support".

As the support, it may preferably be one having conductivity (a conductive support, a cylindrical conductive support). For example, a metallic support may be used which is made of a metal such as aluminum, an aluminum alloy or stainless steel.

The support used in the present invention has a shape of a cylinder, which may preferably have an outer diameter of from 8 mm or more to 180 mm or less, and much preferably from 10 mm or more to 90 mm or less.

The photosensitive layer may be a single-layer type photosensitive layer which contains a charge-generating material and a charge-transporting material in a single layer, or may be a multi-layer type photosensitive layer formed in layers of a charge generation layer which contains a charge-generating material and a charge transport layer which contains a charge-transporting material. From the viewpoint of electrophotographic performance, the multi-layer type photosensitive layer is preferred. The multi-layer type photosensitive layer includes a regular-layer type photosensitive layer in which the charge generation layer and the charge transport layer are superposed in this order from the support side, and a reverse-layer type photosensitive layer in which the charge transport layer and the charge generation layer are superposed in this order from the support side. From the viewpoint of electrophotographic performance, the regular-layer type photosensitive layer is preferred.

In the present invention, for the purpose of covering any defects of the surface of the support, a conductive layer containing a binder resin and metal oxide particles and not containing any antimony is formed on the support.

The metal oxide particles are contained in the conductive layer in order to make the conductive layer have a high electrical conductivity. Hence, the metal oxide particles may preferably be metal oxide particles (conductive metal oxide particles) having a powder resistivity of $1.0\times10^{6}$ Ω·cm or less. Much preferable powder resistivity is $1.0\times10^{3}$ Ω·cm or less. The metal oxide particles may on the other hand preferably have a powder resistivity of $1.0\times10^{0}$ Ω·cm or more.

The powder resistivity of the metal oxide particles is measured in a normal temperature and normal humidity (23° C./50% RH) environment. In the present invention, a resistance measuring instrument manufactured by Mitsubishi Chemical Corporation (trade name: LORESTA GP) is used as a measuring instrument. Measurement object metal oxide particles are compacted at a pressure of 500 kg/cm$^2$ to prepare a pellet-shaped measuring sample. The powder resistivity is measured at an applied voltage of 100 V.

The metal oxide particles to be contained in the conductive layer may include, e.g., the following (1) to (4) particles.

(1) Particles of a metal oxide of an oxygen deficient type; e.g., oxygen deficient tin oxide ($SnO_2$) particles.

(2) Particles of a metal oxide doped with a different element; e.g., tin(Sn)-doped indium oxide($In_2O_3$) particles, aluminum (Al)-doped zinc oxide(ZnO) particles, phosphorus(P)-doped tin oxide($SnO_2$) particles, tungsten(W)-doped tin oxide ($SnO_2$) particles, and fluorine(F)-doped tin oxide($SnO_2$) particles.

(3) Particles of a metal oxide other than the above (1) and (2); e.g., tin oxide($SnO_2$) particles, and iron oxide(FeO, $Fe_3O_4$, $Fe_2O_3$) particles;

(4) Inorganic particles coated with any of the metal oxides according to the above (1) to (3) [composite particles covered with coat layers constituted of any of the metal oxides according to the above (1) to (3)]; e.g., titanium oxide($TiO_2$) particles coated with phosphorus(P)-doped tin oxide($SnO_2$), titanium oxide($TiO_2$) particles coated with tungsten(W)-doped tin oxide($SnO_2$), titanium oxide($TiO_2$) particles coated with fluorine(F)-doped tin oxide($SnO_2$), and titanium oxide($TiO_2$) particles coated with tin(Sn)-doped indium oxide($In_2O_3$).

Of the above (1) to (4) particles, the above (4) particles are preferred.

The inorganic particles (core particles) according to the above (4) particles (composite particles) may preferably be non-conductive inorganic particles having a powder resistivity of from $1.0\times10^{5}$ Ω·cm to $1.0\times10^{10}$ Ω·cm. Of such non-conductive inorganic particles, titanium oxide particles, barium sulfate particles and zirconium oxide particles are preferred, and titanium oxide particles are much preferred. The inorganic particles may also include, as the other examples, silicon oxide particles, zinc oxide particles, aluminum oxide particles, hafnium oxide particles, niobium oxide particles, tantalum oxide particles, magnesium oxide particles, calcium oxide particles, strontium oxide particles, barium oxide particles, yttrium oxide particles, lanthanum oxide particles, cerium oxide particles, indium oxide particles, tin oxide particles, lead oxide particles, lithium niobate particles, potassium niobate particles, lithium tantalate particles, zinc sulfide particles, cadmium sulfide particles, zinc selenide particles, cadmium selenide particles, magnesium acetate particles, magnesium carbonate particles, magnesium chloride particles, magnesium silicofluoride particles, magnesium hydroxide particles, magnesium oxide particles, magnesium nitrate particles, magnesium sulfate particles, calcium acetate particles, calcium dihydrogenphosphate particles, calcium lactate particles, calcium citrate particles, calcium hydroxide particles, calcium carbonate particles, calcium chloride particles, calcium nitrate particles, calcium sulfate particles, calcium thiosulfate particles, strontium hydroxide particles, strontium carbonate particles, strontium nitrate particles, strontium chloride particles, barium acetate particles, barium chloride particles, barium carbonate particles, barium nitrate particles, barium hydroxide particles, and barium fluoride particles.

Of the above (4) particles, the inorganic particles coated with a metal oxide of an oxygen deficient type or the inorganic particles coated with a metal oxide doped with a different element are preferred. Also, of these, the latter inorganic particles coated with a metal oxide doped with a different element are much preferred because, in the former inorganic particles coated with a metal oxide of an oxygen deficient type, the metal oxide of an oxygen deficient type may undergo oxidation when voltage is applied to the conductive layer, to make the metal oxide particles increase in their resistance (i.e., decrease in electrical conductivity).

The different element with which the metal oxide is doped may preferably be in an amount (dope level) of from 0.01% by mass to 30% by mass, and much preferably from 0.1% by mass to 10% by mass, based on the mass of the metal oxide to be doped (the mass not inclusive of that of the different element).

Of the inorganic particles coated with the metal oxide doped with a different element, preferred are particles of titanium oxide($TiO_2$), barium sulfate($BaSO_4$) or zirconium oxide($ZrO_2$) coated with tin oxide($SnO_2$) doped with phosphorus(P), tungsten (W) or fluorine(F).

In the particles of titanium oxide($TiO_2$), barium sulfate ($BaSO_4$) or zirconium oxide($ZrO_2$) coated with tin oxide ($SnO_2$) doped with phosphorus(P), tungsten(W) or fluorine (F), the tin oxide($SnO_2$) may preferably be in a proportion (coverage) of from 10% by mass to 60% by mass, and much preferably from 15% by mass to 55% by mass. To control the coverage of the tin oxide($SnO_2$), a tin raw material necessary to form the tin oxide($SnO_2$) must be compounded when the metal oxide particles are produced. For example, such compounding must be what has taken account of the tin oxide ($SnO_2$) that is formed from a tin raw material tin chloride ($SnCl_4$). Here, the coverage of the tin oxide($SnO_2$) is defined to be a value calculated from the mass of tin oxide($SnO_2$) that is based on the total mass of the tin oxide($SnO_2$) and the titanium oxide($TiO_2$), barium sulfate($BaSO_4$) or zirconium oxide($ZrO_2$), without taking account of the mass of the phosphorus(P), tungsten(W) or fluorine (F) with which the tin oxide($SnO_2$) is doped. Any too small coverage of the tin oxide($SnO_2$) may make it difficult to control the metal oxide particles to have the powder resistivity of $1.0\times10^3$ Ω·cm or less. Any too large coverage thereof tends to make the particles of titanium oxide($TiO_2$), barium sulfate($BaSO_4$) or zirconium oxide($ZrO_2$) non-uniformly coated with tin oxide ($SnO_2$), and also tends to result in a high cost.

Of the particles of titanium oxide($TiO_2$), barium sulfate ($BaSO_4$) or zirconium oxide($ZrO_2$) coated with tin oxide ($SnO_2$) doped with phosphorus(P), tungsten(W) or fluorine (F), particularly preferred are titanium oxide($TiO_2$) particles coated with tin oxide($SnO_2$) doped with phosphorus(P) or tungsten(W).

How to produce such titanium oxide($TiO_2$) particles coated with tin oxide($SnO_2$) doped with phosphorus(P) or tungsten (W) is disclosed in Japanese Patent Application Laid-open No. H06-207118 or No. 2004-349167.

As other metal oxide particles, also preferred are zinc oxide(ZnO) particles doped with aluminum(Al). Such aluminum(Al)-doped zinc oxide(ZnO) particles are considered to be those in which aluminum(Al) is present in zinc oxide (ZnO) in the state of aluminum oxide (alumina($Al_2O_3$)). Thus, it is considered that the metal oxide particles can not easily undergo oxidation even when voltage is applied to the conductive layer and hence the metal oxide particles can not easily vary in resistance (electrical conductivity).

How to produce the aluminum(Al)-doped zinc oxide(ZnO) particles is disclosed in Japanese Patent Application Laid-open No. S58-161923.

The conductive layer may be formed by coating a conductive layer coating fluid obtained by dispersing the metal oxide particles in a solvent together with a binding material, and drying and/or curing the wet coating formed. As a method for dispersion, it may include, e.g., a method making use of a paint shaker, a sand mill, a ball mill or a liquid impact type high-speed dispersion machine.

As the binding material (binder resin) used for the conductive layer, it may include, e.g., phenol resin, polyurethane resin, polyamide resin, polyimide resin, polyamide-imide resin, polyvinyl acetal resin, epoxy resin, acrylic resin, melamine resin, and polyester resin. Any of these may be used alone or in combination of two or more types. Also, of these, from the viewpoints of control of migration (melt-in) to other layers, adhesion to the support, dispersibility and dispersion stability of the metal oxide particles and solvent resistance after film formation, hardening resins are preferred, and heat-hardening resins (thermosetting resins) are much preferred. Still also, of the thermosetting resins, thermosetting phenol resins and thermosetting polyurethane resins are preferred. Where such a thermosetting resin is used as the binding material for the conductive layer, the binding material to be contained in the conductive layer coating fluid serves as a monomer, and/or an oligomer, of thermosetting resin.

The solvent used in preparing the conductive layer coating fluid may include, e.g., alcohols such as methanol, ethanol and isopropanol; ketones such as acetone, methyl ethyl ketone and cyclohexanone; ethers such as tetrahydrofuran, dioxane, ethylene glycol monomethyl ether and propylene glycol monomethyl ether; esters such as methyl acetate and ethyl acetate; and aromatic hydrocarbons such as toluene and xylene.

In the present invention, the metal oxide particles (P) and binding material (B) in the conductive layer coating fluid may preferably be in a mass ratio (P/B) of from 1.0/1.0 or more to 3.5/1.0 or less. Any too smaller quantity of the metal oxide particles than the binding material may make it difficult to control the conductive layer to have the volume conductivity $\rho_1$ of $2.0\times10^{13}$ Ω·cm or less. On the other hand, any too larger quantity of the metal oxide particles than the binding material may make it difficult to control the conductive layer to have the volume conductivity $\rho_1$ of $1.0\times10^8$ Ω·cm or more, and also may make it difficult to bind the metal oxide particles, to tend to cause cracks in the conductive layer.

From the viewpoint of covering any defects of the surface of the support, the conductive layer may preferably have a layer thickness of from 5 μm or more to 40 μm or less.

In the present invention, the layer thickness of each layer, inclusive of the conductive layer, of the electrophotographic photosensitive member is measured with FISCHERSCOPE Multi Measurement System (mms), available from Fisher Instruments Co.

The metal oxide particles used in preparing the conductive layer coating fluid may preferably have an average primary particle diameter of from 0.03 μm or more to 0.50 μm or less, and much preferably from 0.04 μm or more to 0.38 μm or less. Also, where the metal oxide particles are aluminum(Al)-doped zinc oxide(ZnO) particles, such particles may preferably have an average primary particle diameter of from 0.05 μm or more to 0.10 μm or less. Still also, where the metal oxide particles are titanium oxide($TiO_2$) particles coated with phosphorus(P)- or tungsten(W)-doped tin oxide($SnO_2$), such particles may preferably have an average primary particle diameter of from 0.04 μm or more to 0.25 μm or less, and much preferably from 0.05 μm or more to 0.22 μm or less.

In the present invention, the average primary particle diameter of the metal oxide particles is a value found by measuring the specific surface area that is determined by the BET method making measurement by adsorbing nitrogen to particle surfaces, and calculating the results obtained. However, where the metal oxide particles are the composite particles and have a coverage of 60% by mass or less, the thickness of coat layers is negligible as compared with the size of core particles, and hence the average primary particle diameter of the core particles may be regarded as the average primary particle diameter of the metal oxide particles.

Between the conductive layer and the photosensitive layer, a subbing layer (also called a barrier layer or an intermediate layer) having electrical barrier properties may be provided in order to block the injection of electric charges from the conductive layer into the photosensitive layer.

The subbing layer may be formed by coating on the conductive layer a subbing layer coating fluid containing a resin (binder resin), and drying the wet coating formed.

The resin (binder resin) used for the subbing layer may include, e.g., water-soluble resins such as polyvinyl alcohol, polyvinyl methyl ether, polyacrylic acids, methyl cellulose, ethyl cellulose, polyglutamic acid, casein and starch; and polyamide, polyimide, polyamide-imide, polyamic acid, melamine resin, epoxy resin, polyurethane, and polyglutamate. Of these, in order to bring out the electrical barrier properties of the subbing layer effectively, thermoplastic resins are preferred. Of the thermoplastic resins, a thermoplastic polyamide is preferred. As the polyamide, a copolymer nylon or the like is preferred.

The subbing layer may preferably have a layer thickness of from 0.05 μm or more to 5 μm or less, and much preferably from 0.3 μm or more to 1 μm or less.

In order to make the flow of electric charges not stagnate in the subbing layer, the subbing layer may also be incorporated with an electron-transporting material.

The photosensitive layer is formed on the conductive layer (a subbing layer).

The charge-generating material used in the photosensitive layer of the present invention may include, e.g., azo pigments such as monoazo, disazo and trisazo, phthalocyanine pigments such as metal phthalocyanines and metal-free phthalocyanine, indigo pigments such as indigo and thioindigo, perylene pigments such as perylene acid anhydrides and perylene acid imides, polycyclic quinone pigments such as anthraquinone and pyrenequinone, squarilium dyes, pyrylium salts and thiapyrylium salts, triphenylmethane dyes, quinacridone pigments, azulenium salt pigments, cyanine dyes, xanthene dyes, quinoneimine dyes, and styryl dyes. Of these, preferred are metal phthalocyanines such as oxytitanium phthalocyanine, hydroxygallium phthalocyanine and chlorogallium phthalocyanine.

In the case when the photosensitive layer is the multi-layer type photosensitive layer, the charge generation layer may be formed by coating a charge generation layer coating fluid obtained by dispersing the charge generating material in a solvent together with a binder resin, and drying the wet coating formed. As a method for dispersion, a method is available which makes use of a homogenizer, ultrasonic waves, a ball mill, a sand mill, an attritor or a roll mill.

The binder resin used to form the charge generation layer may include, e.g., polycarbonate, polyester, polyarylate, butyral resin, polystyrene, polyvinyl acetal, diallyl phthalate resin, acrylic resin, methacrylic resin, vinyl acetate resin, phenol resin, silicone resin, polysulfone, styrene-butadiene copolymer, alkyd resin, epoxy resin, urea resin, and vinyl chloride-vinyl acetate copolymer. Any of these may be used alone or in the form of a mixture or copolymer of two or more types.

The charge generating material and the binder resin may preferably be in a proportion (charge generating material: binder resin) ranging from 1:0.3 to 1:4 (mass ratio).

The solvent used for the charge generation layer coating fluid may include, e.g., alcohols, sulfoxides, ketones, ethers, esters, aliphatic halogenated hydrocarbons and aromatic compounds.

The charge generation layer may preferably have a layer thickness of from 0.01 μm or more to 5 μm or less, and more preferably from 0.1 μm or more to 2 μm or less.

To the charge generation layer, a sensitizer, an antioxidant, an ultraviolet absorber, a plasticizer and so forth which may be of various types may also optionally be added. An electron transport material (an electron accepting material such as an acceptor) may also be incorporated in the charge generation layer in order to make the flow of electric charges not stagnate in the charge generation layer.

The charge transporting material used in the photosensitive layer may include, e.g., triarylamine compounds, hydrazone compounds, styryl compounds, stilbene compounds, pyrazoline compounds, oxazole compounds, thiazole compounds, and triarylmethane compounds.

In the case when the photosensitive layer is the multi-layer type photosensitive layer, the charge transport layer may be formed by coating a charge transport layer coating fluid obtained by dissolving the charge transporting material and a binder resin in a solvent, and drying the wet coating formed.

The binder resin used to form the charge transport layer may include, e.g., acrylic resin, styrene resin, polyester, polycarbonate, polyarylate, polysulfone, polyphenylene oxide, epoxy resin, polyurethane, alkyd resin and unsaturated resins. Any of these may be used alone or in the form of a mixture or copolymer of two or more types.

The charge transporting material and the binder resin may preferably be in a proportion (charge transporting material: binder resin) ranging from 5:1 to 1:5 (mass ratio), and much preferably from 3:1 to 1:3 (mass ratio).

The solvent used in the charge transport layer coating fluid may include, e.g., ketones such as acetone and methyl ethyl ketone, esters such as methyl acetate and ethyl acetate, ethers such as dimethoxymethane and dimethoxyethane, aromatic hydrocarbons such as toluene and xylene, aromatic hydrocarbons such as toluene and xylene, and hydrocarbons substituted with a halogen atom, such as chlorobenzene, chloroform and carbon tetrachloride.

The charge transport layer may preferably have a layer thickness of from 5 μm or more to 50 μm or less, and much preferably from 8 μm or more to 18 μm or less, from the viewpoint of achieving a high image quality.

To the charge transport layer, an antioxidant, an ultraviolet absorber, a plasticizer and so forth may also optionally be added.

In the case when the photosensitive layer is the single-layer type photosensitive layer, the single-layer type photosensitive layer may be formed by coating a single-layer type photosensitive layer coating fluid containing a charge generating material, a charge transporting material, a binder resin and a solvent, and drying the wet coating formed. As these charge generating material, charge transporting material, binder resin and solvent, the above various ones may be used.

For the purpose of protecting the photosensitive layer, a protective layer may also be provided on the photosensitive layer. The protective layer may be formed by coating a protective layer coating fluid containing a resin (binder resin), and drying and/or curing the wet coating formed.

The binder resin used to form the protective layer may include, e.g., phenol resin, acrylic resin, polystyrene, polyester, polycarbonate, polyarylate, polysulfone, polyphenylene oxide, epoxy resin, polyurethane, alkyd resin, siloxane resin and unsaturated resins. Any of these may be used alone or in the form of a mixture or copolymer of two or more types.

The protective layer may preferably have a layer thickness of from 0.5 μm or more to 7 μm or less, and much preferably from 0.5 μm or more to 5.5 μm or less.

Of the above layers, the layer that serves as a surface layer of the electrophotographic photosensitive member may be incorporated with particles of a fluorine atom-containing resin. Such a fluorine atom-containing resin may include, e.g., tetrafluoroethylene resin, trifluorochloroethylene resin, hexafluoroethylene propylene resin, vinyl fluoride resin, vinylidene fluoride resin, and difluorodichloroethylene resin. It may also include a fluorine graft polymer obtained by copolymerizing an oligomer of 1,000 to 10,000 in molecular weight, having a polymerizable functional group at one terminal of each molecular chain, with a fluorine atom-containing polymerizable monomer.

The surface layer of the electrophotographic photosensitive member may also be incorporated with a resin obtained by copolymerizing an acrylate or methacrylate onto the side chain of which a silicone unit has been grafted, with a vinyl polymerizable monomer such as an acrylate, a methacrylate or styrene.

The surface layer of the electrophotographic photosensitive member may also be incorporated with an antioxidant. Such an antioxidant may include, e.g., antioxidants for plastics, rubbers, petroleum or fats and oils. Of these, hindered amine compounds and hindered phenol compounds are preferred.

The surface layer of the electrophotographic photosensitive member may still also be incorporated with conductive particles such as metal particles or metal oxide particles.

When the coating fluids for the above respective layers are coated, usable are coating methods as exemplified by dip coating (dipping), spray coating, spinner coating, roller coating, Mayer bar coating and blade coating.

Figure 2:
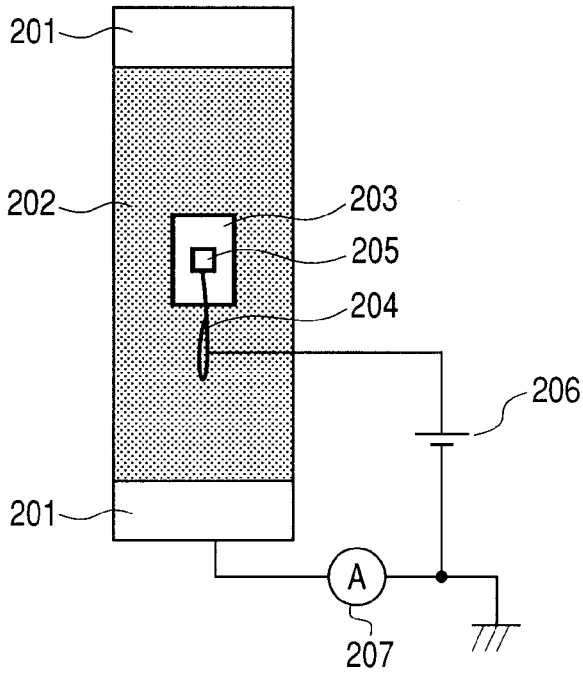
FIG. 2 is a view (plan view) to illustrate how to measure the volume resistivity of a conductive layer.
Figure 3:
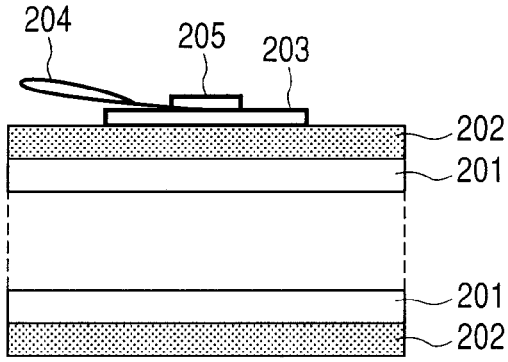
FIG. 3 is a view (sectional view) to illustrate how to measure the volume resistivity of a conductive layer.

How to Measure Volume Resistivity of Conductive Layer:

How to measure the volume resistivity (volume resistivities $\rho_1$ and $\rho_2$) of the conductive layer of the electrophotographic photosensitive member is described below with reference to FIGS. 2 and 3.

First, the electrophotographic photosensitive member is brought into only the support and the conductive layer. As methods therefor, they are roughly grouped into two methods. The first method is a method in which the layers (the photosensitive layer and so forth) above the conductive layer are stripped off to leave only the conductive layer on the support. As a method by which the layers above the conductive layer are stripped off, it may include, e.g., a method in which the corresponding layers are stripped off by using a solvent capable of dissolving the corresponding layers. As long as a directly upper layer of the conductive layer is stripped off by using a solvent capable of dissolving the directly upper layer, the layers above such a directly upper layer can be stripped off together. Instead, the respective layers above the conductive layer may also be stripped off by jetting water streams or the like thereagainst. The second method by which the electrophotographic photosensitive member is brought into only the support and the conductive layer is a method in which only the conductive layer formed on the support and the layers (the photosensitive layer and so forth) above the conductive layer are left not formed. Either of the methods may be employed, where the conductive layer shows the like value for its volume resistivity (volume resistivities $\rho_1$ and $\rho_2$).

The volume resistivity of the conductive layer is measured in a normal temperature and normal humidity (23° C./50% RH) environment. A tape 203 made of copper (Type No. 1181, available from Sumitomo 3M Limited) is stuck to the surface of a conductive layer 202 to make it serve as an electrode on the surface side of the conductive layer 202. The tape 203 made of copper (copper tape 203) is set in a size of 2.50 cm in width, 2.12 cm in length and 5.30 $cm^2$ in area. A support 201 is also made to serve as an electrode on the back side of the conductive layer 202. A power source 206 and a current measuring instrument 207 are respectively set up; the former for applying voltage across the copper tape 203 and the support 201 and the latter for measuring electric current flowing across the copper tape 203 and the support 201.

To make the voltage applicable to the copper tape 203, a copper wire 204 is put on the copper tape 203, and then a tape 205 made of copper like the copper tape 203 is stuck from above the copper wire 204 to the copper tape 203 so that the copper wire 204 may not protrude from the copper tape 203, to fasten the copper wire 204 to the copper tape 203. To the copper tape 203, voltage is applied through the copper wire 204.

A background current value found when any voltage is not applied across the copper tape 203 and the support 201 is represented by $I_0$ (A), a current value found when a voltage of 1 V having only a DC voltage component is applied across the copper tape 203 and the support 201 is represented by I (A), the layer thickness of the conductive layer 202 is represented by d (cm) and the area of the electrode (copper tape 203) on the surface side of the conductive layer 202 is represented by S ($cm^2$), where the value expressed by the following mathematical expression (3) is taken as volume resistivity ρ (Ω·cm) of the conductive layer 202.

$$\rho=1/(I-I_0)\times S/d(\Omega\cdot\text{cm}) \quad (3)$$

In this measurement, the level of electric current of extremely as small as $1\times10^{-6}$ A or less is measured, and hence, it is preferable to make the measurement by using as the current measuring instrument 207 an instrument that can measure an extremely small electric current. Such an instrument may include, e.g., a pA meter (trade name: 4140B) manufactured by Yokogawa Hewlett-Packard Company.

After the volume resistivity of the conductive layer 202 has been measured, the copper tape 203 is removed, and thereafter any adhesive substance of the copper tape 203 is wiped off with a solvent not corrosive of the conductive layer 202 (e.g., 2-butanone), so as not to remain on the surface of the conductive layer 202.

In the present invention, a test is conducted in which a voltage of −1.0 kV having only a DC voltage component is continuously applied to the conductive layer for 1 hour. The volume resistivity p of the conductive layer 202 as measured before this test is conducted is represented by $\rho_1$ (Ω·cm), and the volume resistivity ρ of the conductive layer 202 as measured after this test has been conducted and in the manner as described above is represented by $\rho_2$ (Ω·cm).

Test in which voltage of −1.0 kV having only DC voltage component is continuously applied to conductive layer for 1 hour:

The test in which a voltage of −1.0 kV having only a DC voltage component is continuously applied to the conductive layer for 1 hour is described below with reference to FIGS. 4 and 5. This test is hereinafter also called "DC voltage continuous application test".

Figure 4:
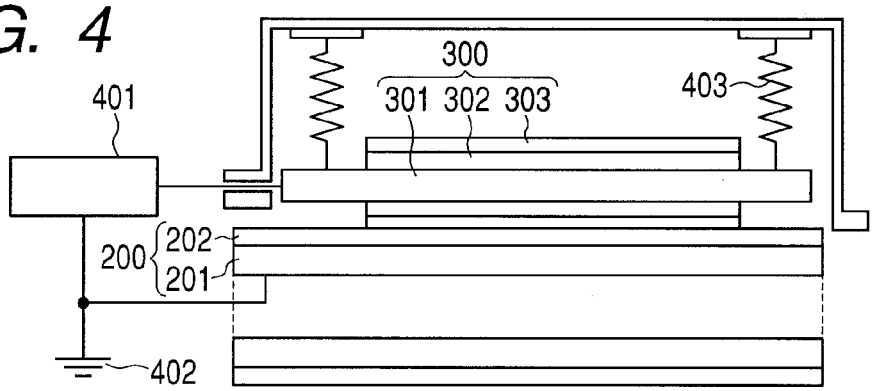
FIG. 4 is a view to illustrate a test in which a voltage of −1.0 kV having only a DC voltage component is continuously applied to a conductive layer for 1 hour.

FIG. 4 is a view to illustrate the DC voltage continuous application test. The DC voltage continuous application test is conducted in a normal temperature and normal humidity (23° C./50% RH) environment.

First, what has been brought into only the support 201 and the conductive layer 202 (hereinafter called a "test sample"), 200, and a conductive roller 300 having a mandrel 301, an elastic layer 302 and a surface layer 303 are brought into contact with each other in such a way that the both are axially in parallel. In doing so, a load of 500 g is applied to both end portions of the mandrel 301 of the conductive roller 300 by means of springs 403. The mandrel 301 of the conductive roller 300 is connected to a DC power source 401, and the support 201 of the conductive roller 300 is connected to the ground, 402. The test sample 200 is driven and rotated at a number of revolutions of 200 rpm, and the conductive roller 300 is follow-up rotated at the same speed, where the voltage of −1.0 kV (constant voltage) having only a DC voltage component is continuously applied to the conductive roller 300 for 1 hour. How to bring the electrophotographic photosensitive member into only the support and the conductive layer is as described above.

Figure 5:
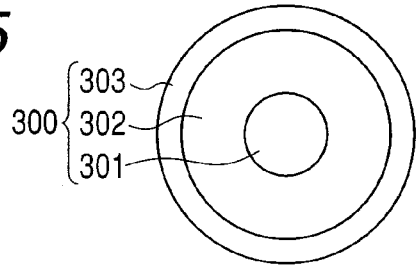
FIG. 5 is a view showing schematically the construction of a conductive roller.

FIG. 5 is a view showing schematically the construction of the conductive roller 300 used in the above test.

The conductive roller 300 is constituted of a medium-resistant surface layer 303 which controls the resistance of the conductive roller 300, a conductive elastic layer 302 having elasticity necessary to form a uniform nip to the surface of the test sample 200, and the mandrel 301.

In order that the voltage of −1.0 kV having only a DC voltage component is continuously applied to the conductive layer 202 of the test sample 200 stably for 1 hour, it is necessary to keep constant the nip between the test sample 200 and the conductive roller 300. In order to keep this nip constant, the hardness of the elastic layer 302 of the conductive roller 300 and the strength of the springs 403 may appropriately be controlled. Besides, a mechanism for nip adjustment may be provided.

As the conductive roller 300, what was made in the following way was used. In the following, "part(s)" refers to "part(s) by mass".

As the mandrel 301, a mandrel was used which was 6 mm in diameter and made of stainless steel.

Next, the elastic layer 302 was formed on the mandrel 301 in the following way.

The following materials were kneaded for 10 minutes by means of an enclosed mixer temperature-controlled at 50° C., to prepare a raw-material compound (formulation).

| | |
|---|---|
| Epichlorohydrin rubber terpolymer (epichlorohydrin:ethylene oxide:allyl glycidyl ether = 40 mol %:56 mol %:4 mol %) | 100 parts |
| Calcium carbonate (soft type) | 30 parts |
| Aliphatic polyester (plasticizer) | 5 parts |
| Zinc stearate | 1 part |
| 2-Mercaptobenzimidazole (antioxidant) | 0.5 part |
| Zinc oxide | 5 parts |
| Quaternary ammonium salt represented by the following formula | 2 parts |

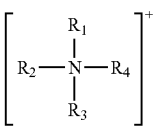

$R_1 = CH_3(CH_2)_6CH_2$
$R_2 = CH_3$
$R_3 = CH_3$
$R_4 = CH_2CH_2OH$
$X = ClO_4$
$n = 1$

| | |
|---|---|
| Carbon black (surface-untreated product; average particle diameter: 0.2 μm; powder resistivity: 0.1 Ω · cm) | 5 parts |

To this compound, 1 part of sulfur as a vulcanizing agent, 1 part of dibenzothiazyl sulfide as a vulcanization accelerator and 0.5 part of tetramethylthiuram monosulfide, all based on 100 parts of the above epichlorohydrin rubber terpolymer as a raw-material rubber, were added and these were kneaded for 10 minutes by means of a twin-roll mill cooled to 20° C.

The compound obtained by this kneading was extruded by means of an extruder onto the mandrel 301, which was so extruded as to be in the shape of a roller of 15 mm in outer diameter. The extruded product was vulcanized with heated steam, and thereafter so worked by abrasion as to have an outer diameter of 10 mm, to obtain a roller having the mandrel 301 and the elastic layer 302 formed thereon. Here, in the step of abrasion working, a full-width abrasion method was employed. The elastic layer was set to 232 mm in length.

Next, on the elastic layer 302, the surface layer 301 was formed by coating in the following way.

The following materials were used to prepare a fluid mixture in a glass bottle as a container.

| | |
|---|---|
| Caprolactone modified acrylic-polyol solution | 100 parts |
| Methyl isobutyl ketone | 250 parts |
| Conductive tin oxide($SnO_2$) (trifluoropropyltrimethoxysilane-treated product; average particle diameter: 0.05 μm; powder resistivity: $1 \times 10^3$ Ω · cm) | 250 parts |
| Hydrophobic silica (dimethylpolysiloxane-treated product; average particle diameter: 0.02 μm; powder resistivity: $1 \times 10^{16}$ Ω · cm) | 3 parts |
| Modified dimethylsilicone oil | 0.08 part |
| Cross-linked PMMA particles (average particle diameter: 4.98 μm) | 80 parts |

The fluid mixture obtained was put into a paint shaker dispersion machine, and glass beads of 0.8 mm in average particle diameter as dispersing media were so filled therein as to be in a fill of 80%, where dispersion treatment was carried out for 18 hours to prepare a fluid dispersion.

To the fluid dispersion obtained, a 1:1 mixture of butanone oxime blocks of hexamethylene diisocyanate (HDI) and isophorone diisocyanate (IPDI) each was so added as to be NCO/OH=1.0, to prepare a surface layer coating fluid.

This surface layer coating fluid was coated twice on the elastic layer 302 of the elastic roller by dip coating, followed by air drying, and thereafter drying at a temperature of 160° C. for 1 hour to form the surface layer 303.

Thus, the conductive roller 300 was produced, having the mandrel 301, the elastic layer 302 and the surface layer 303.

The resistance of the conductive roller produced was measured in the following way to find that it was $1.0\times10^5\Omega$.

Figure 6:
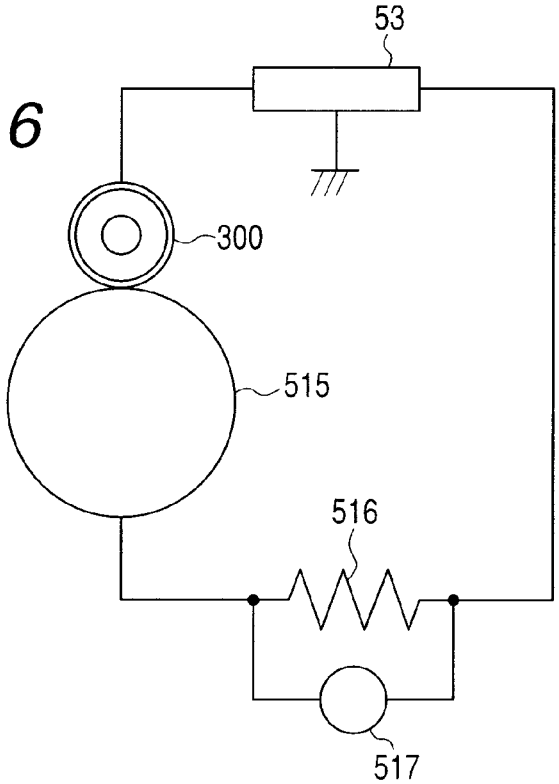
FIG. 6 is a view to illustrate how to measure the resistance of the conductive roller.

FIG. 6 is a view to illustrate how to measure the resistance of the conductive roller.

The resistance of the conductive roller is measured in a normal temperature and normal humidity (23° C./50% RH) environment.

A cylindrical electrode 515 made of stainless steel and the conductive roller 300 are brought into contact with each other in such a way that the both are axially in parallel. In doing so, a load of 500 g is applied to both end portions of a mandrel (not shown) of the conductive roller 300. As the cylindrical electrode 515, one having the same diameter as the above test sample is chosen and used. In the state of such contact with each other, the cylindrical electrode 515 is driven and rotated at a number of revolutions of 200 rpm, and the conductive roller 300 is follow-up rotated at the same speed, where a voltage of −200 V is applied to the cylindrical electrode 515 from an external power source 53. Here, the resistance calculated from the value of electric current flowing through the conductive roller 300 is taken as the resistance of the conductive roller 300. In FIG. 6, reference numeral 516 denotes a resistance (element); and 517, a recorder.

FIG. 1 schematically shows an example of the construction of an electrophotographic apparatus having a process cartridge provided with the electrophotographic photosensitive member of the present invention.

In FIG. 1, reference numeral 1 denotes a drum-shaped electrophotographic photosensitive member, which is rotatingly driven around an axis 2 in the direction of an arrow at a stated peripheral speed.

The peripheral surface of the electrophotographic photosensitive member 1 rotatingly driven is uniformly electrostatically charged to a positive or negative, stated potential through a charging means (primary charging means; e.g., a charging roller) 3. The electrophotographic photosensitive member thus charged is then exposed to exposure light (imagewise exposure light) 4 emitted from an exposure means (an imagewise exposure means; not shown) for slit exposure, laser beam scanning exposure or the like. In this way, electrostatic latent images corresponding to the intended image are successively formed on the peripheral surface of the electrophotographic photosensitive member 1. Voltage to be applied to the charging means 3 may be only DC (direct-current) voltage or may be DC (direct-current) voltage on which AC (alternating-current) voltage is kept superimposed.

The electrostatic latent images thus formed on the peripheral surface of the electrophotographic photosensitive member 1 are developed with a toner of a developing means 5 to form toner images. Then, the toner images thus formed and held on the peripheral surface of the electrophotographic photosensitive member 1 are transferred to a transfer material (such as paper) P by applying a transfer bias from a transfer means (such as a transfer roller) 6. The transfer material P is fed through a transfer material feed means (not shown) to come to the part (contact zone) between the electrophotographic photosensitive member 1 and the transfer means 6 in the manner synchronized with the rotation of the electrophotographic photosensitive member 1.

The transfer material P to which the toner images have been transferred is separated from the peripheral surface of the electrophotographic photosensitive member 1 and is led into a fixing means 8, where the toner images are fixed, and is then put out of the apparatus as an image-formed material (a print or copy).

The peripheral surface of the electrophotographic photosensitive member 1 from which toner images have been transferred is brought to removal of the toner remaining after the transfer, through a cleaning means (such as a cleaning blade) 7. It is further subjected to charge elimination by pre-exposure light 11 emitted from a pre-exposure means (not shown), and thereafter repeatedly used for the formation of images. Incidentally, the pre-exposure is not necessarily required where the charging means is a contact charging means.

The apparatus may be constituted of a combination of plural components integrally joined in a container as a process cartridge from among the constituents such as the above electrophotographic photosensitive member 1, charging means 3, developing means 5, transfer means 6 and cleaning means 7 so that the process cartridge is set detachably mountable to the main body of an electrophotographic apparatus. In what is shown in FIG. 1, the electrophotographic photosensitive member 1 and the charging means 3, developing means 5 and cleaning means 7 are integrally supported to form a cartridge to set up a process cartridge 9 that is detachably mountable to the main body of the electrophotographic apparatus through a guide means 10 such as rails provided in the main body of the electrophotographic apparatus.

The electrophotographic photosensitive member of the present invention may preferably be used in color (or full-color) electrophotographic apparatus (such as those of a multiple transfer system, an intermediate transfer system or an in-line system) in which halftone images and solid images are frequently reproduced.

EXAMPLES

The present invention is described below in greater detail by giving specific working examples. The present invention, however, is by no means limited to these. In the following Examples, "part(s)" refers to "part(s) by mass".

Conductive Layer Coating Dispersion Preparation Examples

Preparation Example of Conductive Layer Coating Fluid L-1

60 parts of aluminum(Al)-doped zinc oxide(ZnO) particles (average primary particle diameter: 0.075 μm; powder resistivity: 300 Ω·cm; amount of aluminum(Al) doped to zinc oxide(ZnO) (dope level as alumina($Al_2O_3$)): 7% by mass) as metal oxide particles, 36.5 parts of phenol resin (trade name: PLYOPHEN J-325; available from Dainippon Ink & Chemicals, Incorporated; resin solid content: 60% by mass) as a binder resin and 50 parts of methoxypropanol as a solvent were put into a sand mill making use of glass beads of 0.5 mm in diameter, to carry out dispersion under conditions of a number of disk revolutions of 2,500 rpm and a dispersion treatment time of 3.5 hours to obtain a fluid dispersion.

To this fluid dispersion, 3.9 parts of silicone resin particles (trade name: TOSPEARL 120; available from GE Toshiba Silicones; average particle diameter: 2 μm) as a surface roughness providing material and 0.001 part of silicone oil (trade name: SH28PA; available from Dow Corning Toray Silicone Co., Ltd.) as a leveling agent were added, followed by stirring to prepare a conductive layer coating fluid L-1.

Preparation Examples of Conductive Layer Coating Fluids L-2 to L-42

Conductive layer coating fluids L-2 to L-42 were prepared in the same manner as Preparation Example of Conductive Layer Coating Dispersion L-1 except that the metal oxide particles used therein in preparing the conductive layer coating fluid were respectively changed as shown in Table 1.

TABLE 1

| Conductive layer coating fluid | Metal oxide particles: Material | Coverage of $SnO_2$ (ms. %) | Dope level to $SnO_2$ (ms. %) (dope element) | Dope level to ZnO (ms. %) (dope element) | Av. primary particle diam. (μm) | Powder resistivity (Ω · cm) | *1 Amt. of particles (pbm) |
|---|---|---|---|---|---|---|---|
| L-1 | Al-doped ZnO particles | — | — | 7(Al) | 0.075 | 300 | 60 |
| L-2 | Al-doped ZnO particles | — | — | 6.8(Al) | 0.100 | 200 | 53 |
| L-3 | Al-doped ZnO particles | — | — | 6.5(Al) | 0.050 | 500 | 66 |
| L-4 | $TiO_2$ particles coated with P-doped $SnO_2$ | 15 | 7(P) | — | 0.150 | 200 | 54.8 |
| L-5 | $TiO_2$ particles coated with P-doped $SnO_2$ | 20 | 7(P) | — | 0.070 | 300 | 60 |
| L-6 | $TiO_2$ particles coated with P-doped $SnO_2$ | 15 | 7(P) | — | 0.180 | 150 | 50 |
| L-7 | $TiO_2$ particles coated with P-doped $SnO_2$ | 15 | 7(P) | — | 0.220 | 100 | 46 |
| L-8 | $TiO_2$ particles coated with P-doped $SnO_2$ | 20 | 8(P) | — | 0.050 | 400 | 62.5 |
| L-9 | $TiO_2$ particles coated with W-doped $SnO_2$ | 15 | 7(W) | — | 0.150 | 250 | 57 |
| L-10 | $TiO_2$ particles coated with W-doped $SnO_2$ | 15 | 7(W) | — | 0.220 | 150 | 53 |
| L-11 | $TiO_2$ particles coated with W-doped $SnO_2$ | 20 | 8(W) | — | 0.050 | 450 | 64.5 |
| L-12 | Al-doped ZnO particles | — | — | 7(Al) | 0.075 | 300 | 40 |
| L-13 | $TiO_2$ particles coated with P-doped $SnO_2$ | 15 | 7(P) | — | 0.150 | 200 | 33 |
| L-14 | $TiO_2$ particles coated with W-doped $SnO_2$ | 15 | 7(W) | — | 0.150 | 250 | 37.5 |
| L-15 | Al-doped ZnO particles | — | — | 7(Al) | 0.075 | 300 | 70 |
| | | Coverage of tin oxide (ms. %) | | | | | |
| L-16 | $TiO_2$ particles coated with P-doped $SnO_2$ | 15 | 7(P) | — | 0.150 | 200 | 65.5 |
| L-17 | $TiO_2$ particles coated with W-doped $SnO_2$ | 15 | 7(P) | — | 0.150 | 250 | 70 |
| L-18 | Al-doped ZnO particles | — | — | 6.5(Al) | 0.120 | 100 | 28.5 |
| L-19 | Al-doped ZnO particles | — | — | 6.5(Al) | 0.120 | 100 | 44 |
| L-20 | Al-doped ZnO particles | — | — | 6.5(Al) | 0.120 | 100 | 55 |
| L-21 | $TiO_2$ particles coated with P-doped $SnO_2$ | 20 | 8(P) | — | 0.040 | 500 | 44 |
| L-22 | $TiO_2$ particles coated with W-doped $SnO_2$ | 20 | 8(W) | — | 0.040 | 550 | 46 |
| L-23 | $TiO_2$ particles coated with P-doped $SnO_2$ | 20 | 8(P) | — | 0.040 | 500 | 65.5 |
| L-24 | $TiO_2$ particles coated with W-doped $SnO_2$ | 20 | 8(W) | — | 0.040 | 550 | 70 |
| L-25 | $TiO_2$ particles coated with P-doped $SnO_2$ | 20 | 8(P) | — | 0.040 | 500 | 76.5 |
| L-26 | $TiO_2$ particles coated with W-doped $SnO_2$ | 20 | 8(P) | — | 0.040 | 550 | 79 |
| L-27 | Ga-doped ZnO particles | — | — | 7(Ga) | 0.075 | 200 | 33 |
| L-28 | Ga-doped ZnO particles | — | — | 7(Ga) | 0.075 | 200 | 55 |
| L-29 | In-doped ZnO particles | — | — | 7.5(In) | 0.075 | 250 | 65.5 |
| L-30 | $TiO_2$ particles coated with F-doped $SnO_2$ | 15 | 7(F) | — | 0.075 | 300 | 60 |
| L-31 | ZnO particles | — | — | — | 0.075 | 1,000 | 55 |
| L-32 | ZnO particles | — | — | — | 0.075 | 1,000 | 76.5 |
| L-33 | ZnO particles | — | — | — | 0.075 | 1,000 | 98.5 |
| L-34 | $TiO_2$ particles coated with oxygen deficient $SnO_2$ | 15 | — | — | 0.240 | 800 | 40 |
| L-35 | $TiO_2$ particles coated with oxygen deficient $SnO_2$ | 20 | — | — | 0.240 | 700 | 52.5 |
| L-36 | $TiO_2$ particles coated with oxygen deficient $SnO_2$ | 20 | — | — | 0.240 | 700 | 61.5 |
| L-37 | ZnO particles | — | — | — | 0.075 | 1,000 | 55 |
| L-38 | ZnO particles | — | — | — | 0.075 | 1,000 | 70 |
| L-39 | ZnO particles | — | — | — | 0.075 | 1,000 | 100 |

TABLE 1-continued

| Conductive layer coating fluid | Metal oxide particles: Material | | Dope level to $SnO_2$ (ms. %) (dope element) | Dope level to ZnO (ms. %) (dope element) | Av. primary particle diam. (μm) | Powder resistivity (Ω · cm) | *1 Amt. of particles (pbm) |
|---|---|---|---|---|---|---|---|
| L-40 | $BaSO_4$ particles coated with oxygen deficient $SnO_2$ | 12 | — | — | 0.350 | 1,000 | 44 |
| L-41 | $BaSO_4$ particles coated with oxygen deficient $SnO_2$ | 12 | — | — | 0.350 | 1,000 | 55 |
| L-42 | $TiO_2$ particles coated with oxygen deficient $SnO_2$ | 20 | — | — | 0.240 | 700 | 70 |

*1: Amount of metal oxide particles used in preparing conductive layer coating fluid (parts by mass)
Dope level in Al-doped ZnO particles is in terms of alumina ($Al_2O_3$).

Electrophotographic Photosensitive Member Production Examples

Production Example of Electrophotographic Photosensitive Member 1

An aluminum cylinder (JIS A3003, aluminum alloy) of 357.5 mm in length and 30 mm in diameter which was produced by a production process having the step of extrusion and the step of drawing was used as a support.

The conductive layer coating fluid L-1 was dip-coated on the support in a 22° C./55% RH environment, and then the wet coating formed was dried and heat-cured at 140° C. for 30 minutes to form a conductive layer with a layer thickness of 30 μm.

Next, 4.5 parts of N-methoxymethylated nylon (trade name: TORESIN EF-30T; available from Teikoku Chemical Industry Co., Ltd.) and 1.5 parts of copolymer nylon resin (trade name: AMILAN CM8000; available from Toray Industries, Inc.) were dissolved in a mixed solvent of 65 parts of methanol and 30 parts of n-butanol to prepare a subbing layer coating fluid. This subbing layer coating fluid obtained was dip-coated on the conductive layer, and then the wet coating formed was dried at 70° C. for 6 minutes to form a subbing layer with a layer thickness of 0.85 μm.

Next, 10 parts of hydroxygallium phthalocyanine crystals (charge-generating material) with a crystal form having intense peaks at 7.5°, 9.9°, 16.3°, 18.6°, 25.1° and 28.3° of the Bragg's angle 2θ±0.2° in CuKα characteristic X-ray diffraction, 5 parts of polyvinyl butyral resin (trade name: S-LEC BX-1; available from Sekisui Chemical Co., Ltd.) and 250 parts of cyclohexanone were put into a sand mill making use of glass beads of 1 mm in diameter, and put to dispersion treatment under conditions of a dispersion treatment time of 3 hours. Next, to the resultant system, 250 parts of ethyl acetate was added to prepare a charge generation layer coating fluid. This charge generation layer coating fluid was dip-coated on the subbing layer, and then the wet coating formed was dried at 100° C. for 10 minutes to form a charge generation layer with a layer thickness of 0.12 μm.

Next, 8 parts of an amine compound (charge-transporting material) represented by the following structural formula (CT-1):

(CT-1)

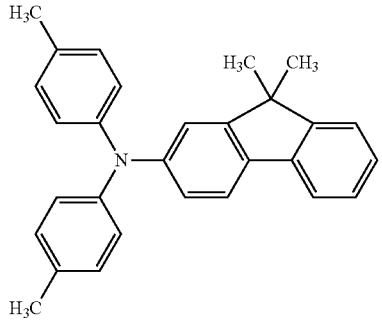

and 10 parts of polycarbonate resin (trade name: Z200; available from Mitsubishi Engineering-Plastics Corporation) were dissolved in a mixed solvent of 30 parts of dimethoxymethane and 70 parts of chlorobenzene to prepare a charge transport layer coating fluid. This charge transport layer coating fluid was dip-coated on the charge generation layer, and then the wet coating formed was dried at 110° C. for 30 minutes to form a charge transport layer with a layer thickness of 15 μm.

Thus, an electrophotographic photosensitive member 1 was produced the charge transport layer of which was a surface layer.

Besides the electrophotographic photosensitive member 1, another electrophotographic photosensitive member 1 was also produced so as to be used for producing the above test sample 200.

The first-produced electrophotographic photosensitive member 1 is called "electrophotographic photosensitive member 1-1", and the second-produced electrophotographic photosensitive member 1 for producing the test sample is called "electrophotographic photosensitive member 1-2". Likewise hereinafter, first-produced electrophotographic photosensitive members are consecutively numbered with the subgroup number "-1", and second-produced electrophotographic photosensitive members for the test sample, with the subgroup number "-2"

Production Examples of Electrophotographic Photosensitive Members 2 to 42

Electrophotographic photosensitive members 2 to 42 the charge transport layers of which were surface layers were produced in twos in the same manner as Production Example of Electrophotographic Photosensitive Member 1 except that, as shown in Table 2, the conductive layer coating fluid 1 used in producing the electrophotographic photosensitive member was changed for conductive layer coating fluids 2 to 42, respectively.

TABLE 2

| Conductive layer coating fluid used in producing electro-photographic photosensitive member | Electrophotographic photosensitive member | Electrophotographic photosensitive member for producing test sample |
|---|---|---|
| L-1 | 1-1 | 1-2 |
| L-2 | 2-1 | 2-2 |
| L-3 | 3-1 | 3-2 |
| L-4 | 4-1 | 4-2 |
| L-5 | 5-1 | 5-2 |
| L-6 | 6-1 | 6-2 |
| L-7 | 7-1 | 7-2 |
| L-8 | 8-1 | 8-2 |
| L-9 | 9-1 | 9-2 |
| L-10 | 10-1 | 10-2 |
| L-11 | 11-1 | 11-2 |
| L-12 | 12-1 | 12-2 |
| L-13 | 13-1 | 13-2 |
| L-14 | 14-1 | 14-2 |
| L-15 | 15-1 | 15-2 |
| L-16 | 16-1 | 16-2 |
| L-17 | 17-1 | 17-2 |
| L-18 | 18-1 | 18-2 |
| L-19 | 19-1 | 19-2 |
| L-20 | 20-1 | 20-2 |
| L-21 | 21-1 | 21-2 |
| L-22 | 22-1 | 22-2 |
| L-23 | 23-1 | 23-2 |
| L-24 | 24-1 | 24-2 |
| L-25 | 25-1 | 25-2 |
| L-26 | 26-1 | 26-2 |
| L-27 | 27-1 | 27-2 |
| L-28 | 28-1 | 28-2 |
| L-29 | 29-1 | 29-2 |
| L-30 | 30-1 | 30-2 |
| L-31 | 31-1 | 31-2 |
| L-32 | 32-1 | 32-2 |
| L-33 | 33-1 | 33-2 |
| L-34 | 34-1 | 34-2 |
| L-35 | 35-1 | 35-2 |
| L-36 | 36-1 | 36-2 |
| L-37 | 37-1 | 37-2 |
| L-38 | 38-1 | 38-2 |
| L-39 | 39-1 | 39-2 |
| L-40 | 40-1 | 40-2 |
| L-41 | 41-1 | 41-2 |
| L-42 | 42-1 | 42-2 |

Examples 1 to 36 & Comparative Examples 1 to 6

Of the electrophotographic photosensitive members 1 to 42, the charge transport layer, charge generation layer and subbing layer of each of the electrophotographic photosensitive members 1-2 to 42-2 for producing test samples were stripped off by using a solvent to make conductive layers bare to produce test samples. Hereinafter, these are called test samples 1 to 42, respectively, in order.

Using the test samples 1 to 42, first the volume resistivity $\rho_1$ of each conductive layer before the DC voltage continuous application test described previously was conducted was measured by the method described previously. Next, the DC voltage continuous application test was conducted, and thereafter the volume resistivity $\rho_2$ of each conductive layer was again measured at the same spot. Incidentally, the layer thickness of the conductive layer at the spot where the volume resistivity was measured was separately beforehand measured. The results of measurement of the volume resistivities $\rho_1$ and $\rho_2$ are shown in Table 3. In Table 3, "R" refers to the value of $\log|\rho_2|-\log|\rho_1|$, which is the rate of change between $\rho_1$ and $\rho_2$.

In regard to the electrophotographic photosensitive members 1 and 4, test samples were also separately produced by a method in which only the conductive layer was formed on the support, and the volume resistivities $\rho_1$ and $\rho_2$ of their conductive layers before and after the DC voltage continuous application test were measured by the same method as that for the above test samples 1 and 4. As the result, the like values as the test samples 1 and 4 were respectively obtained on the both volume resistivities $\rho_1$ and $\rho_2$.

Meanwhile, of the electrophotographic photosensitive members 1 to 42, the electrophotographic photosensitive members 1-1 to 42-1 were each set in a conversion machine of a copying machine (trade name: GP405) manufactured by CANON INC.), used as an evaluation apparatus. This was placed in a normal temperature and low humidity (23° C./5% RH) environment, and a running test was conducted to make evaluation of electric potential (evaluation on potential variation). Its details are as follows:

The evaluation apparatus had a process speed of 210 mm/second. The evaluation apparatus also had a charging means (primary charging means) which is a charging means of a contact charging type in which a voltage formed by superimposing an AC voltage on a DC voltage is applied to a charging roller kept brought into contact with the surface of the electrophotographic photosensitive member, to charge the surface of the electrophotographic photosensitive member electrostatically. The evaluation apparatus still also had an exposure means (imagewise exposure means) which is an exposure means making use of laser beams (wavelength: 780 nm) as exposure light. The evaluation apparatus still also had a developing means which is a developing means of a one-component magnetic negative toner non-contact development system. The evaluation apparatus still also had a transfer means which is a transfer means of a roller type contact transfer system. The evaluation apparatus still also had a cleaning means which is a cleaning means making use of a rubber cleaning blade set in the counter direction. The evaluation apparatus still also had a pre-exposure means which is a pre-exposure means making use of a fuse lamp.

The evaluation was made according to the following (i), (ii) and (iii).

(i) Evaluation of Initial-Stage Potential:

The electrophotographic photosensitive members 1-1 to 42-1 were, in order to make them adaptable to the above normal temperature and normal humidity environment, each left to stand for 48 hours in the like environment, and thereafter set in the evaluation apparatus.

The AC component of the voltage applied to the charging roller was set to a peak-to-peak voltage of 1,500 V and a frequency of 1,500 Hz and the DC component thereof was set to −850 V. The laser exposure level was also so controlled that, in each electrophotographic photosensitive member, its initial-stage light-area potential (Vla) standing before long-period running test came to be −200 V, and its initial-stage residual potential (Vsla) standing before long-period running test was measured which was done after one rotation of intense exposure.

To measure the surface potential of the electrophotographic photosensitive member, a developing cartridge was pulled out of the evaluation apparatus, and a potential measuring instrument was inserted to that part. The potential measuring instrument was set up by disposing a potential measuring probe at the developing position of the developing cartridge, and the potential measuring probe was positioned at the middle in the axial direction of the electrophotographic photosensitive member, leaving a gap of 3 mm from the surface of the electrophotographic photosensitive member.

(ii) Evaluation of Potential after Long-Period Running Test:

Keeping the charging conditions (AC component and DC component) and exposure conditions as they were, which were set at the (i) initial-stage evaluation in each electrophotographic photosensitive member, the surface potential after long-period running test was evaluated in the following way.

The potential measuring instrument was detached and the developing cartridge was attached instead, where a long-period running test was conducted by A4-sheet 3,000-sheet paper feed running. Here, as sequence of the long-period running test, an intermittent mode was set up in which, in 6% image area printing, the printing was posed once for each sheet (8 seconds/sheet).

After the long-period running test was finished, the developing cartridge was detached and the potential measuring instrument was attached instead, where light-area potential (Vlb) standing after long-period running test and residual potential (Vslb) standing after long-period running test were measured in the same way as the above (i). Differences (variation levels) between these light-area potential (Vlb) and residual potential (Vslb) and the initial-stage light-area potential (Vla) and initial-stage residual potential (Vsla) measured in the above (i) were ascertained. These differences are taken as long-period running test ΔVl(ab) and long-period running test ΔVsl(ab), respectively.

$$Vla-Vlb=\Delta Vl(ab)$$

$$Vsla-Vslb=\Delta Vsl(ab)$$

(iii) Evaluation of Potential after Short-Period Running Test:

Following the long-period running test, a short-period running test was conducted in the following way.

First, light-area potential (Vlc) standing before short-period running test and residual potential (Vslc) standing after short-period running test were measured. After these were measured, a short-period running test was conducted which was of no paper feeding (corresponding to A4-sheet 999 sheets, where electrostatic latent images were formed but any development and cleaning were not performed; as sequence, a continuous mode was set up in which the electrostatic latent images were continuously formed for the 999 sheets).

After the short-period running test was finished, light-area potential (Vld) standing after short-period running test and residual potential (Vsld) standing after short-period running test were measured in the same way as the above (i). Differences (variation levels) between these light-area potential (Vld) and residual potential (Vsld) and the light-area potential (Vlc) and residual potential (Vslc) were ascertained. These differences are taken as short-period running test ΔVl (cd) and short-period running test ΔVsl(cd), respectively.

$$Vlc-Vld=\Delta Vl(cd)$$

$$Vslc-Vsld=\Delta Vsl(cd)$$

The results of the foregoing are shown in Table 3.

TABLE 3

| | Electro-photographic photosensitive member | Test sample | Volume resistivity of conductive layer $\rho_1$ (Ω · cm) | $\rho_2$ (Ω · cm) | R | Evaluation results ΔVl(ab) (V) | ΔVsl(ab) (V) | ΔVl(cd) (V) | ΔVsl(cd) (V) |
|---|---|---|---|---|---|---|---|---|---|
| Example | | | | | | | | | |
| 1 | 1 | 1 | $3.6 \times 10^{10}$ | $3.6 \times 10^{10}$ | 0.00 | −1 | +1 | 0 | 0 |
| 2 | 2 | 2 | $4.1 \times 10^{10}$ | $1.3 \times 10^{10}$ | −0.50 | −5 | −5 | −5 | −5 |
| 3 | 3 | 3 | $2.5 \times 10^{10}$ | $7.9 \times 10^{10}$ | 0.50 | +2 | +5 | +3 | +5 |
| 4 | 4 | 4 | $3.5 \times 10^{10}$ | $3.5 \times 10^{10}$ | 0.00 | +1 | +1 | 0 | 0 |
| 5 | 5 | 5 | $5.5 \times 10^{10}$ | $5.5 \times 10^{10}$ | 0.00 | +1 | +2 | +1 | +2 |
| 6 | 6 | 6 | $2.1 \times 10^{10}$ | $2.1 \times 10^{10}$ | 0.00 | +2 | +3 | +1 | +2 |
| 7 | 7 | 7 | $4.4 \times 10^{10}$ | $1.4 \times 10^{10}$ | −0.50 | −4 | +4 | −4 | +4 |
| 8 | 8 | 8 | $6.0 \times 10^{10}$ | $1.9 \times 10^{11}$ | 0.50 | +5 | +5 | +5 | +5 |
| 9 | 9 | 9 | $7.0 \times 10^{10}$ | $7.0 \times 10^{10}$ | 0.00 | +3 | +3 | +2 | +5 |
| 10 | 10 | 10 | $3.5 \times 10^{10}$ | $1.1 \times 10^{10}$ | −0.50 | −8 | 0 | −5 | 0 |
| 11 | 11 | 11 | $3.8 \times 10^{10}$ | $1.2 \times 10^{11}$ | 0.50 | +9 | +10 | +5 | +10 |
| 12 | 12 | 12 | $2.0 \times 10^{13}$ | $2.0 \times 10^{13}$ | 0.00 | −1 | +1 | −1 | +1 |
| 13 | 13 | 13 | $2.0 \times 10^{13}$ | $2.0 \times 10^{13}$ | 0.00 | +1 | +1 | +1 | +1 |
| 14 | 14 | 14 | $2.0 \times 10^{13}$ | $2.0 \times 10^{13}$ | 0.00 | +3 | +3 | +3 | +5 |
| 15 | 15 | 15 | $1.0 \times 10^{8}$ | $1.0 \times 10^{8}$ | 0.00 | −2 | +2 | −2 | 0 |
| 16 | 16 | 16 | $1.0 \times 10^{8}$ | $1.0 \times 10^{8}$ | 0.00 | +1 | +2 | +1 | +1 |
| 17 | 17 | 17 | $1.0 \times 10^{8}$ | $1.0 \times 10^{8}$ | 0.00 | +3 | +3 | +2 | +5 |
| 18 | 18 | 18 | $2.0 \times 10^{13}$ | $2.0 \times 10^{12}$ | −1.00 | −20 | −10 | −10 | −10 |
| 19 | 19 | 19 | $3.2 \times 10^{10}$ | $3.2 \times 10^{9}$ | −1.00 | −10 | −5 | −5 | −5 |
| 20 | 20 | 20 | $1.0 \times 10^{8}$ | $1.0 \times 10^{7}$ | −1.00 | −15 | −7 | −7 | −7 |
| 21 | 21 | 21 | $2.0 \times 10^{13}$ | $2.0 \times 10^{14}$ | 1.00 | +15 | +12 | +7 | +12 |
| 22 | 22 | 22 | $2.0 \times 10^{13}$ | $2.0 \times 10^{14}$ | 1.00 | +20 | +15 | +10 | +15 |
| 23 | 23 | 23 | $2.2 \times 10^{10}$ | $2.2 \times 10^{11}$ | 1.00 | +10 | +10 | +5 | +10 |
| 24 | 24 | 24 | $4.0 \times 10^{10}$ | $4.0 \times 10^{11}$ | 1.00 | +15 | +15 | +7 | +15 |
| 25 | 25 | 25 | $1.0 \times 10^{8}$ | $1.0 \times 10^{9}$ | 1.00 | +15 | +12 | +7 | +12 |
| 26 | 26 | 26 | $1.0 \times 10^{8}$ | $1.0 \times 10^{9}$ | 1.00 | +20 | +15 | +10 | +15 |
| 27 | 27 | 27 | $2.0 \times 10^{13}$ | $6.3 \times 10^{11}$ | −1.50 | −25 | −20 | −20 | −20 |
| 28 | 28 | 28 | $3.8 \times 10^{10}$ | $1.2 \times 10^{9}$ | −1.50 | −25 | −10 | −20 | −10 |
| 29 | 29 | 29 | $1.0 \times 10^{8}$ | $3.2 \times 10^{6}$ | −1.50 | −25 | −15 | −20 | −15 |
| 30 | 30 | 30 | $3.5 \times 10^{10}$ | $1.1 \times 10^{12}$ | 1.50 | +24 | +25 | +15 | +25 |
| 31 | 31 | 31 | $2.0 \times 10^{13}$ | $2.0 \times 10^{11}$ | −2.00 | −30 | −32 | −25 | −30 |
| 32 | 32 | 32 | $3.5 \times 10^{10}$ | $3.5 \times 10^{8}$ | −2.00 | −30 | −30 | −25 | −28 |
| 33 | 33 | 33 | $1.0 \times 10^{8}$ | $1.0 \times 10^{6}$ | −2.00 | −28 | −32 | −25 | −30 |
| 34 | 34 | 34 | $2.0 \times 10^{13}$ | $2.0 \times 10^{15}$ | 2.00 | +30 | +38 | +25 | +38 |
| 35 | 35 | 35 | $3.5 \times 10^{10}$ | $3.5 \times 10^{12}$ | 2.00 | +26 | +30 | +20 | +30 |
| 36 | 36 | 36 | $1.0 \times 10^{8}$ | $1.0 \times 10^{10}$ | 2.00 | +28 | +35 | +22 | +35 |

TABLE 3-continued

| | Electro-photographic photosensitive member | Test sample | Volume resistivity of conductive layer $\rho_1$ ($\Omega \cdot$ cm) | $\rho_2$ ($\Omega \cdot$ cm) | R | Evaluation results ΔVl(ab) (V) | ΔVsl(ab) (V) | ΔVl(cd) (V) | ΔVsl(cd) (V) |
|---|---|---|---|---|---|---|---|---|---|
| Comparative Example: | | | | | | | | | |
| 1 | 37 | 37 | $3.0 \times 10^{13}$ | $9.5 \times 10^{10}$ | −2.50 | −100 | −100 | −120 | −50 |
| 2 | 38 | 38 | $3.5 \times 10^{10}$ | $1.1 \times 10^{8}$ | −2.50 | −75 | −75 | −50 | −50 |
| 3 | 39 | 39 | $1.0 \times 10^{7}$ | $3.2 \times 10^{4}$ | −2.50 | −100 | −100 | −120 | −50 |
| 4 | 40 | 40 | $3.0 \times 10^{13}$ | $8.0 \times 10^{15}$ | 2.50 | +100 | +150 | +120 | +150 |
| 5 | 41 | 41 | $3.5 \times 10^{10}$ | $1.1 \times 10^{13}$ | 2.50 | +75 | +100 | +30 | +100 |
| 6 | 42 | 42 | $1.0 \times 10^{7}$ | $3.2 \times 10^{9}$ | 2.50 | +100 | +150 | +50 | +100 |

From the results of Examples and Comparative Examples, it is seen that the light-area potential and residual potential in reproducing images repeatedly may less vary when the volume resistivity $\rho_1$ of each conductive layer as measured before the DC voltage continuous application test and the volume resistivity $\rho_2$ of each conductive layer as measured after the DC voltage continuous application test satisfy:

$$-2.00 \leq (\log|\rho_2| - \log|\rho_1|) \leq 2.00 \text{ and } 1.0\times10^{8} \leq \rho_1 \leq 2.0\times10^{13}.$$

Then, it is seen that the light-area potential and residual potential in reproducing images repeatedly may much less vary when they satisfy:

$$-1.50 \leq (\log|\rho_2| - \log|\rho_1|) \leq 1.50.$$

That is, the more the value of $\log|\rho_2| - \log|\rho_1|$ comes to 0 (zero), the less the light-area potential and residual potential in reproducing images repeatedly may vary.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-204523, filed Sep. 4, 2009, Japanese Patent Application No. 2010-134305, filed Jun. 11, 2010, and Japanese Patent Application No. 2010-196406, filed Sep. 2, 2010, which are hereby incorporated by reference herein in their entirety.

The invention claimed is:

1. An electrophotographic photosensitive member comprising:

a cylindrical support;

a conductive layer formed on the cylindrical support, the conductive layer containing a binding material and metal oxide particles, and not containing any antimony; and a photosensitive layer formed on the conductive layer;

wherein the metal oxide particles are at least one selected from the group consisting of:

zinc oxide particles doped with aluminum, gallium or indium, particles of titanium oxide coated with tin oxide doped with phosphorus, tungsten or fluorine, particles of barium sulfate coated with tin oxide doped with phosphorus, tungsten or fluorine, and particles of zirconium oxide coated with tin oxide doped with phosphorus, tungsten or fluorine;

wherein:

the metal oxide particles are doped in an amount of from 0.01% by mass to 30% by mass based on the mass of the metal oxide to be doped, the metal oxide particles have an average primary particle diameter of from 0.03 to 0.50 μm, where a test in which a voltage of −1.0 kV having only a DC voltage component is continuously applied to the conductive layer for 1 hour is conducted, the conductive layer has volume resistivity satisfying the following mathematical expressions (1) and (2), as values before and after the test:

$$-0.50 \leq (\log|\rho_2| - \log|\rho_1|) \leq 0.50 \quad (1), \text{ and}$$

$$1.0\times10^{8} \leq \rho_1 \leq 2.0\times10^{13} \quad (2),$$

where, in the expressions (1) and (2), $\rho_1$ is volume resistivity ($\Omega\cdot$cm) of the conductive layer as measured before the test and $\rho_2$ is volume resistivity ($\Omega\cdot$cm) of the conductive layer as measured after the test.

2. The electrophotographic photosensitive member according to claim 1, wherein the metal oxide particles are zinc oxide particles doped with aluminum.

3. The electrophotographic photosensitive member according to claim 1, wherein the metal oxide particles are titanium oxide particles coated with tin oxide doped with phosphorus.

4. A process cartridge which integrally supports the electrophotographic photosensitive member according to claim 1 and at least one means selected from the group consisting of a charging means, a developing means, a transfer means and a cleaning means, and is detachably mountable to the main body of an electrophotographic apparatus.

5. An electrophotographic apparatus comprising the electrophotographic photosensitive member according to claim 1, a charging means, an exposure means, a developing means and a transfer means.

6. The electrophotographic photosensitive member according to claim 2, wherein the conductive layer is formed by the use of the zinc oxide particles doped with aluminum having a powder resistivity of from 200 to 500 $\Omega\cdot$cm and an average primary particle diameter of from 0.050 to 0.100 μm.

7. The electrophotographic photosensitive member according to claim 3, wherein the conductive layer is formed by the use of the titanium oxide particles coated with tin oxide doped with phosphorus having a powder resistivity of from 200 to 400 $\Omega\cdot$cm and an average primary particle diameter of from 0.050 to 0.220 μm.

8. The electrophotographic photosensitive member according to claim 7, wherein the tin oxide in the particles of titanium oxide coated with tin oxide is coated in a coverage of from 10% by mass to 60% by mass.

* * * * *